US007656364B2

(12) United States Patent
Masini

(10) Patent No.: US 7,656,364 B2
(45) Date of Patent: Feb. 2, 2010

(54) SYSTEMS AND METHODS FOR A MULTI-MODE RECONFIGURABLE SECTOR ANTENNA

(75) Inventor: Gino Luca Masini, Milan (IT)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 106 days.

(21) Appl. No.: 12/065,191

(22) PCT Filed: Aug. 30, 2005

(86) PCT No.: PCT/EP2005/054250

§ 371 (c)(1),
(2), (4) Date: Apr. 4, 2008

(87) PCT Pub. No.: WO2007/025568

PCT Pub. Date: Mar. 8, 2007

(65) Prior Publication Data

US 2008/0186251 A1 Aug. 7, 2008

(51) Int. Cl.
*H01Q 21/00* (2006.01)

(52) U.S. Cl. ..... 343/893; 343/700 MS

(58) Field of Classification Search ..... 343/700 MS, 343/772, 893

See application file for complete search history.

(56) References Cited

U.S. PATENT DOCUMENTS

| | | | | |
|---|---|---|---|---|
| 5,579,019 | A * | 11/1996 | Uematsu et al. | 343/771 |
| 7,498,994 | B2 * | 3/2009 | Vacanti | 343/725 |
| 2002/0126048 | A1 * | 9/2002 | Zhu et al. | 343/700 MS |
| 2005/0057429 | A1 | 3/2005 | Charlton | |

* cited by examiner

*Primary Examiner*—Tan Ho
(74) *Attorney, Agent, or Firm*—Michael G. Cameron

(57) ABSTRACT

Systems and methods for configuring a single sector antenna capable of operating in multiple modes and comprising a plurality of radiating arrays to radiate over a sector area at a polarization by activating a single radiating array. An enabler activates a single radiating array in a single-unit sector antenna that comprises multiple radiating arrays to allow the sector antenna to operate in the desired mode without interference from additional active radiating arrays, the sector antenna being capable of reconfiguration without unit replacement or system losses to operate in a different mode.

23 Claims, 3 Drawing Sheets

SYSTEMS AND METHODS FOR A MULTI-MODE RECONFIGURABLE SECTOR ANTENNA

FIELD OF THE INVENTION

The present invention relates generally to sector antennas and, more specifically, to systems and methods for a configurable sector antenna with a plurality of radiating arrays capable of radiating at one of a plurality of sector angles to cover one of a plurality of sector areas based on the characteristics of an active radiating array.

BACKGROUND OF THE INVENTION

An antenna is an electrical device that sends or receives signals. More specifically, an antenna acts as the port through which radio frequency (RF) energy is radiated to or received from the outside world. A common antenna is an omnidirectional antenna. An omnidirectional antenna radiates in all directions, essentially in a 360 degree pattern. However, such an antenna is an inefficient solution for a problem requiring more directed or focused radiation. A single robust antenna capable of focusing its radiated power on one of several particular areas is desirable partly because of its efficient power allocation and partly because of the direct cost savings in production and potential use in more advanced commercial applications.

A sector antenna provides a common solution to this problem. A sector antenna is an antenna that divides a 360 degree spherical area into smaller segments, such as two 180, three 120, or four 90 degree areas. The sector antenna then generally radiates primarily in a direction of a particular segment to provide a more focused radiation to a particular geographic location. This concentrated radiation in a particular direction increases the directive gain of the antenna, making the antenna more efficient. There are however drawbacks to these standard sector antennas. Each particular sector antenna is designed and constructed to radiate only at a particular degree angle to cover a predetermined area. Once constructed to meet these predetermined specifications, the standard sector antenna cannot be modified. For example, a sector antenna may be constructed to direct its radiation at a 45 degree angle to cover a particular geographic area. A problem arises if the application changes and it becomes necessary to radiate towards a different area, or at a different angle. In such a case, one must design and manufacture several sector antennas for various aperture angles corresponding to different geographic areas. Because each sector antenna is suited only for a particular scenario, it is necessary to change the characteristics of the antenna to respond to a change in the scenario. Thus, one traditionally has been required to swap the antenna with a replacement sector antenna suited for the new scenario, or to electrically modify the existing antenna to address the change in the scenario. A replacement antenna increases the production cost, as two separate antennas must be manufactured, and requires complete replacement of the entire antenna.

In certain instances, a sector antenna may be electrically modifiable, or "smart". A smart sector antenna may be used in an attempt to meet different parameters or specifications. A switched beam antenna is just such a type of smart antenna. However, a switched beam antenna concurrently produces multiple beams, resulting in a more complex and costly design, and multiple active beams result in losses and inefficiencies. Generally, a two-way antenna to handle the above-described smart sector antenna, built with an electrically modifiable radio frequency (RF) switch has about a 3 to 3.5 dB loss due to the electronic reconfiguration when compared to a standard non-reconfigurable sector antenna. This loss is unacceptable in many sensitive applications. Thus, a smart sector antenna is not a viable option in many instances due to system complexity, cost, and its inherent additional signal losses.

Furthermore, sector antennas are constructed to radiate at a fixed polarization. Polarization of an antenna relates to the orientation of electromagnetic waves at a distance from their source. For example, the electromagnetic waves may be oriented vertically or horizontally. Proper polarization maximizes antenna performance, and generally, the best results are achieved when the polarization of a transmitting antenna matches the polarization of a receiving antenna. The polarization and directivity of such antennas are built into the antenna radiator structure and cannot be changed. Thus, a problem arises when a need exists to radiate a signal over an area with a polarization that does not match the polarization of the sector antenna. In such a case, replacement of the sector antenna and its resulting drawbacks is again the only viable option.

SUMMARY OF THE INVENTION

From the foregoing, it is apparent that there is a direct need for a single configurable sector antenna capable of activating one of a plurality of radiating arrays to radiate in one of a plurality of directions to meet the changing needs of a user, avoid replacement of the entire sector antenna, and effect a production cost savings as a result of high volume manufacture of a single unit, robust, multi mode product, all while avoiding losses in signal strength resulting from the electrical modification of the sector antenna. Further, it is desirable to provide a single sector antenna capable of being configured to radiate with different polarizations in order to meet varying end user polarization requirements. Thus, the aim of the present invention is to overcome the above mentioned problems by providing systems and methods related to a single configurable sector antenna capable of activating one of a plurality of radiating arrays to radiate at one of a plurality of different angles over a plurality of geographical locations at multiple polarities.

Within this aim, the present invention features systems and methods for a sector antenna configurable to radiate in at least one of a plurality of sector areas by activating one of a plurality of radiating arrays. To increase efficiency and reduce cost, a single sector antenna assembly includes a plurality of radiating arrays, each with different characteristics, wherein a single radiating array is active at a particular time. Further, based on the active radiating array, the single sector antenna may radiate signals with different polarizations. This reduces cost, facilitates robust high volume manufacturing of a single product capable of multiple applications, and improves efficiency and performance.

This aim and others are achieved by a sector antenna apparatus configurable to radiate in at least one of a plurality of sector areas, comprising: at least one sector antenna mounted to a housing; a waveguide mounted to the housing; the at least one sector antenna comprising a first radiating array capable of activation by engagement with the waveguide to radiate a first beam covering a first sector area; the at least one sector antenna comprising a second radiating array capable of activation by engagement with the waveguide to radiate a second beam covering a second sector area; and an enabler to activate one of the first radiating array and the second radiating array by engaging the waveguide with one of the first radiating array and the second radiating array so that the sector antenna radiates one of the first beam and the second beam.

The above mentioned aim and others are also achieved by a method for configuring a sector antenna to radiate in at least one of a plurality of sector areas, comprising: providing a sector antenna mounted to a housing; mounting a waveguide to a housing; providing, included in the sector antenna, a first radiating array capable of activation by engagement with the waveguide to radiate a first beam covering a first sector area; providing, included in the sector antenna, a second radiating array capable of activation by engagement with the waveguide to radiate a second beam covering a second sector area; determining which of the first radiating array and the second radiating array to activate; activating one of the first radiating array and the second radiating array by engaging the waveguide with one of the first radiating array and the second radiating array; and radiating from the sector antenna one of the first beam and the second beam.

In one aspect, the invention features a sector antenna apparatus configurable to radiate over at least one of a plurality of sector areas. The sector antenna apparatus may include at least one sector antenna mounted to a housing and at least one waveguide mounted to the housing. In certain embodiments, a sector antenna may include a patch antenna. In an embodiment a sector antenna may include a point to multipoint base station sector antenna. The at least one sector antenna includes a first radiating array that may become active, (i.e., it radiates) when it is engaged with the waveguide. The first radiating array emits a first beam. In an embodiment, the first beam may be a signal, such as an RF signal that covers a first sector area, which is generally a geographic area. The invention also includes a second radiating array that may become active upon engagement with the waveguide. The second radiating array emits a second beam that covers a second sector area, which is also generally a geographic area. In an embodiment, the second sector area is smaller than and includes a portion of the first sector area. In other embodiments, the first sector area and the second sector area do not overlap at all. In an embodiment, only one of the first radiating array and the second radiating array may be active at any given time.

The invention also includes an enabler to activate either the first radiating array or the second radiating array by coupling one of the first and second radiating arrays to the waveguide. This coupling may include any effective connection between the waveguide and one of the radiating arrays that allows signal propagation so the sector antenna may radiate in accordance with the active radiating array. In an embodiment, the enabler may include a mechanical switch, microstrip waveguide transition or any device to facilitate a mechanical connection. Preferably, the enabler activates either the first radiating array, causing the first beam to radiate, or the second radiating array, causing the second beam to radiate. In some embodiments, the enabler activates the first radiating array or the second radiating array during assembly of the sector antenna apparatus. In other embodiments, this enablement occurs after assembly is complete, and in certain embodiments, this enablement may be made by a field service technician after the apparatus has been put into use for a particular application. In various embodiments the enabler may also disable the active first radiating array or second radiating array, and may mechanically reconfigure the sector antenna apparatus by then enabling the previously inactive first or second radiating array.

In certain embodiments, the first radiating array or the second radiating array may include a third beam covering a third sector area. This third sector area may include a portion of the first sector area or the second sector area, and this third sector area in combination with the second sector area, may equal or exceed the geographic area defined by first sector area.

Another aspect of the invention includes a method for configuring a sector antenna to radiate in at least one of a plurality of sector areas. This method comprises providing a sector antenna and a waveguide, both mounted to the housing, as well as providing a first radiating array and a second radiating array. When active, the first radiating array is capable of producing a first radiating beam and the second radiating array is capable of producing a second beam. The first beam radiates over a first sector area, a geographic area, and the second beam radiates over a second sector area, also a geographic area. The method includes the step of determining which of the first radiating array and the second radiating array to activate, as well as the step of activating at least one of these arrays by engaging the waveguide with either the first radiating array or the second radiating array to radiate from the sector antenna the corresponding first beam or second beam over the appropriate geographic area.

In certain embodiments, the method may include the step of deactivating the active first or second radiating array, and then activating the other, previously inactive array. In various embodiments, this activation may occur during or after manufacture of the apparatus defined by the method, and a human service provider may manipulate the enabler so as to activate, or deactivate, either the first or the second radiating array, or to first deactivate one radiating array and then to activate another radiating array. Other aspects and advantages of the present invention will become apparent from the following detailed description, taken in conjunction with the accompanying drawings, illustrating the principles of the invention by way of example only.

BRIEF DESCRIPTION OF THE DRAWINGS

The foregoing and other objects, features, and advantages of the present invention, as well as the invention itself, will be more fully understood from the following description of various embodiments, when read together with the accompanying drawings, in which.

DETAILED DESCRIPTION OF THE INVENTION

Figure 1A:
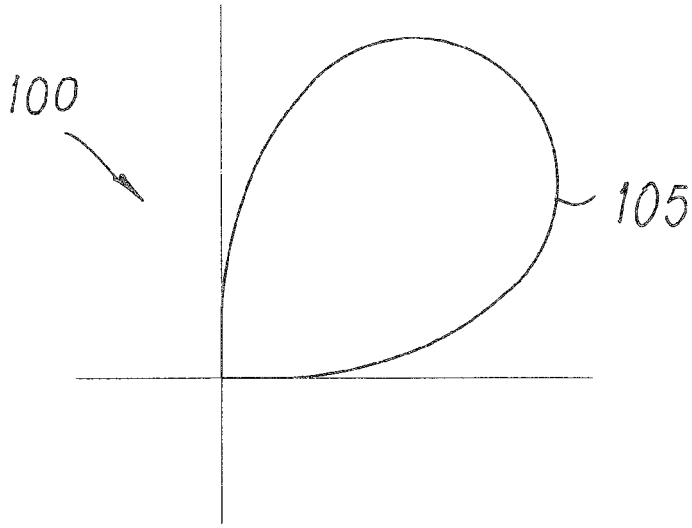
FIG. 1*a* is a simplified azimuth graph depicting a representative 90 degree sector area into which a sector antenna is capable of radiating in accordance with an embodiment of the invention.

As shown in the drawings for the purposes of illustration, the invention may be embodied in systems and methods for radiating a beam from a sector antenna in one of a plurality of directions. These directions include at least one defined sector area. Embodiments of the invention allow for configuration of the sector antenna to enable one of a plurality of radiating arrays to radiate over one of a plurality of sector areas, during or after assembly of the sector antenna where the sector antenna has been activated to radiate over a single sector area at any given time, and where this sector antenna may be reconfigured to radiate over an alternate sector area.

In brief overview, FIG. 1*a* is a simplified azimuth graph 100 depicting a representative 90 degree aperture angle corresponding to sector area 105 into which a sector antenna is capable of radiating in accordance with an embodiment of the invention. An azimuth graph generally depicts an antenna radiation pattern as seen looking down from directly above the antenna. Generally, the sector antenna radiates over only one sector area at any point in time. In the embodiment illustrated in this Figure, the sector antenna has been enabled by activating a radiating array to radiate in sector area 105, illustrated as corresponding to quadrant I of the simplified azimuth graph, although in various embodiments, the sector antenna may radiate in any direction, and the degree of radiation may vary from a 0 to 360 degree sector angle. Thus, in this embodiment, the sector antenna, configured to radiate over (i.e., into) multiple sector areas, has been enabled and activated to radiate over sector area 105, as illustrated by the corresponding simplified azimuth radiation pattern.

Figure 1B:
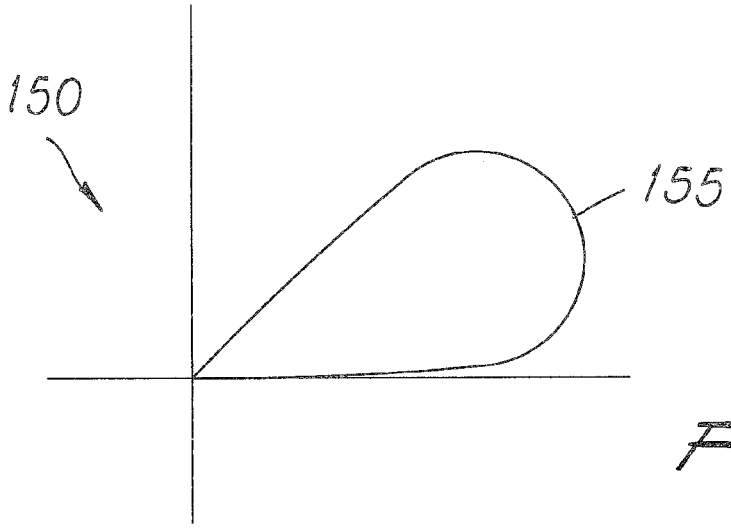
FIG. 1*b* is a simplified azimuth graph depicting a representative 45 degree sector area into which a sector antenna is capable of radiating in accordance with an embodiment of the invention.

FIG. 1*b* is a simplified azimuth graph 150 depicting a representative 45 degree aperture angle corresponding to sector area 155 into which a sector antenna may radiate in accordance with an embodiment of the invention. In the embodiment illustrated in this Figure, the sector antenna has been enabled to radiate in sector area 155, illustrated as corresponding to a portion of quadrant I of the simplified azimuth graph. Sector area 155 generally covers a different geographic area than sector area 105. In various embodiments, sector area 155 may overlap or partially overlap with sector area 105. In an embodiment, sector area 155 may be a subset of sector area 105, or vice-versa. In the illustrated embodiment, the sector antenna, configured to radiate over (i.e., into) multiple sector areas, has been enabled and activated to radiate in sector area 155, as illustrated by the corresponding simplified azimuth radiation pattern.

Figure 1C:
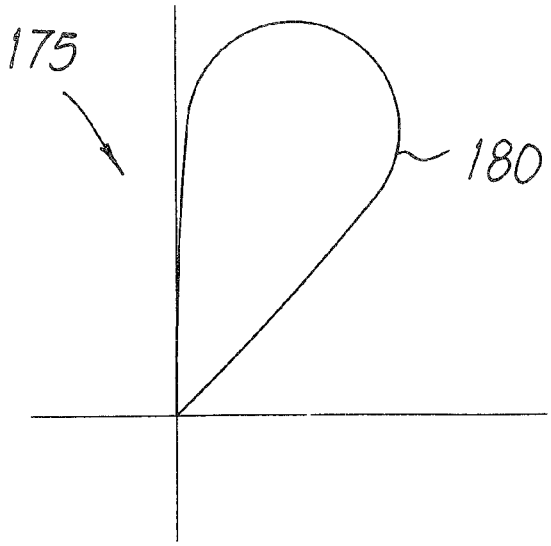
FIG. 1*c* is a simplified azimuth graph depicting an alternate representative 45 degree sector area into which a sector antenna is capable of radiating in accordance with an embodiment of the invention.

FIG. 1*c* is a simplified azimuth graph 175 depicting an alternative representative 45 degree aperture angle corresponding to sector area 180 into which a sector antenna may radiate in accordance with an embodiment of the invention. In the embodiment illustrated in this Figure, the sector antenna has been enabled to radiate in sector area 180, illustrated as corresponding to a portion of quadrant I of the simplified azimuth graph. Sector area 180 generally covers a different geographic area than both sector area 105 and sector area 155. In various embodiments, sector area 180 may overlap or partially overlap with sector area 105, sector area 155, or both sector area 105 and sector area 155. In other embodiments, there may be no overlap between any sector area 105, sector area 155, and sector area 180. In an embodiment, sector area 180 may be a subset of sector area 105, sector area 155, or both. In an embodiment, the sum of the areas defined by sector area 180 and sector area 155 may equal the area defined by sector area 105. In the illustrated embodiment, the sector antenna, configured to radiate over (i.e., into) multiple sector areas, has been enabled and activated to radiate in sector area 155, as illustrated by the corresponding simplified azimuth radiation pattern.

Figure 2:
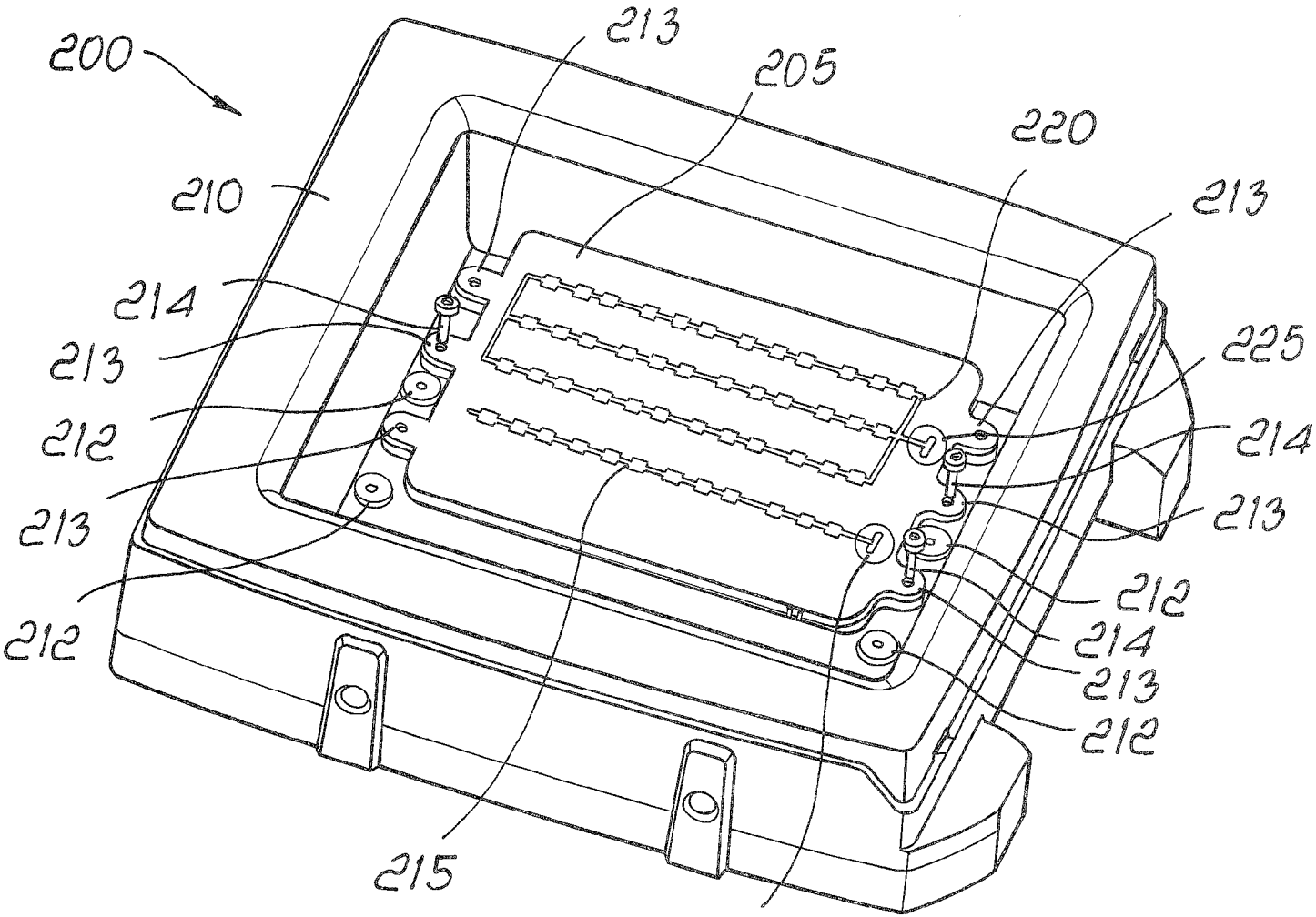
FIG. 2 is a partial cutaway view depicting a sector antenna apparatus with multiple radiating arrays configurable to radiate in one of a plurality of sector areas in accordance with an embodiment of the invention.

In brief overview, FIG. 2 is a partial cutaway view depicting a system 200 including a sector antenna apparatus with multiple radiating arrays configurable to radiate in one of a plurality of sector areas by activating one of the radiating arrays in accordance with an embodiment of the invention. Apparatus 200 typically includes at least one sector antenna 205. Generally, sector antenna 205 is any antenna capable of focusing a radiated signal on a particular geographic area. In the illustrated embodiment, sector antenna 205 includes at least one patch antenna. In an embodiment, sector antenna 205 may also include at least one point-to-multipoint base station sector antenna. Generally, a base station includes generalized equipment for providing connectivity, management, and control of another station, known as a subscriber station, and a point-to-multipoint base station sector antenna refers to a topology wherein a base station simultaneously services multiple, geographically separated subscriber stations and each subscriber station is permanently associated with only one base station.

Sector antenna 205 is generally mounted to a housing 210. Housing 210 typically includes any housing, or casing, sufficient to protect sector antenna 205 from debris and damage while allowing sector antenna 205 to remain in a position to radiate or receive a signal. In an embodiment, housing 210 completely encases sector antenna 205. In another embodiment, housing 210 partially encases sector antenna while leaving portions of sector antenna 205 exposed. Housing 210 may include a radome, alternatively known as a radar dome (not depicted) to further shield sector antenna 205 from the environment. The radome may take the shape of a geodesic dome and encases housing 210 and sector antenna 205. Housing 210 also incorporates a waveguide (not shown). A waveguide may be any structure or device that confines and guides a propagating electromagnetic wave. In an embodiment, the waveguide may be integral to housing 210, and may be machined into housing 210. In an alternate embodiment, the waveguide may be a separate element, mounted to or associated with housing 210 or sector antenna 205. As viewed in the illustrative embodiment, the waveguide ends in the bottom of housing 210, with an external flange.

In the embodiment illustrated in FIG. 2, housing 210 is mounted to sector antenna 205 by a series of threaded holes 212, mounting holes 213, and fasteners 214. In an embodiment, threaded holes 212 are integral to housing 210, and mounted holes 213 are integral to sector antenna 205. Threaded holes 212 and mounted holes 213 are properly aligned, and fastener 214 passes through threaded holes 212 and mounted holes 213 to lock sector antenna 205 and housing 210 into position. Once properly fastened, sector antenna 205 generally cannot move relative to housing 210. Of course, in various embodiments, any means for mounting system 200 components together may be used. For example, fastener 214 may include a bolt, a screw, a solder joint, spot weld, or other connection to securely fix the position of sector antenna 205 relative to housing 210.

System 200 also includes a first radiating array 215 and a second radiating array 220. First radiating array 215 generally generates the first beam (also called a communication beam or signal) that radiates over a first sector area. The first sector area is typically the geographic area over which the first beam is radiated. In the same way, the second radiating array 220 generates a second beam that radiates over a second sector area. In an embodiment, first radiating array 215 is integral to sector antenna 205. In various embodiments, first radiating array 215 may be coupled or otherwise linked to sector antenna 205. Thus, first radiating array 215 is capable of generating a first beam for radiation over a first sector area, and second radiating array 220 is capable of generating a second beam for radiation over a second sector area. To prevent the introduction of losses, generally, first radiating array 215 and second radiating array 220 are positioned on sector antenna 205 sufficiently far apart from each other so that they do not unintentionally couple to each other.

Typically, first sector area and second sector area do not overlap. However, in various embodiments, first sector area and second sector area may partially or wholly overlap or a particular sector area may be entirely included within the boundaries of another sector area. In certain embodiments there may be more than two radiating arrays, and generally each radiating array generates a beam for radiation over a particular sector area unique to that radiating array. For example, in an embodiment with a third radiating array (not shown), the third radiating array generates a beam for radiation over a third sector area. First, second and third sector areas may or may not overlap in various embodiments. In an embodiment, the sum of any number of sector areas may equal or exceed the area covered by another sector area.

In the exemplary embodiment illustrated by FIG. 2, sector antenna 205 includes a patch antenna, first radiating array 215 includes a single row of patches capable of generating a 90 degree beam to radiate over a first sector area and second radiating array 220 includes a triple row of patches capable of generating a 45 degree beam. In various embodiments, sector antenna 205 may include a plurality of radiating arrays of any configuration capable of generating a plurality of beams, at any angle between 0 and 360 to radiate over a plurality of sector areas.

System 200 also includes at least one enabler 225. Generally an enabler is a device capable of making sector antenna 205 operational by enabling a beam to radiate via the waveguide. Enabler 225 may include a transition, such as for example a microstrip-waveguide transition. The beam generally originates at an active radiating array. A radiating array, such as for example first radiating array 215 or second radiating array 220, becomes active when it engages the waveguide to radiate its corresponding first beam or second beam to radiate over the first sector area or second sector area. Enabler 225 engages the waveguide with a radiating array, such as first radiating array 215 or second radiating array 220. In an embodiment, enabler 225 may include a mechanical device or object physically connecting the waveguide with a radiating array. For example, the mechanical device may include any mechanical connector or transition that facilitates signal propagation from a radiating array through the waveguide.

Enabler 225 may be permanently attached to the waveguide and reversibly attachable to any radiating array present on sector antenna 205. The enabler is then attached to the appropriate radiating array to activate that particular radiating array to radiate the desired beam over the desired area. Generally only one radiating array is active at any one time. In various embodiments, enabler 225 is capable of deactivating an active radiating array by disengaging that radiating array from the waveguide. This causes radiation of the beam from that particular radiating array to cease. In this illustrative embodiment, enabler 225 may then activate another radiating array to radiate a different beam over a different sector area.

In an embodiment enabler 225 activates a particular radiating array by engaging it with the waveguide during production or assembly of sector antenna 205. This may occur for example when the initial application of system 200 is known prior to production. Enabler 225 may be manipulated by a human, such as a service technician, to enable a particular radiating array. This may be done before, during, or after production according to various embodiments. Furthermore, in an embodiment, the human may manipulate enabler 225 to disengage an active radiating array from the waveguide, and then to subsequently engage a different radiating array to the waveguide to cause a change in the sector area over which a beam is radiated. In an embodiment, this may occur by wholly or partially physically disconnecting sector antenna 205 from housing 210, manipulating enabler 225 to deactivate one radiating array and to activate the desired radiating array and re-connecting sector antenna 205 with housing 210. In a further embodiment, enabler 225 may respond automatically to user instructions regarding which of a plurality of radiating arrays to activate. For example, enabler 225 may include an electromechanical device capable of responding to remote user input to activate (or deactivate) a particular radiating array.

Both first radiating array 215 and second radiating array 220, as well as any additional arrays present in various embodiments, are capable of activation and there is effectively only one active radiating array at any one time. An activated radiating array is typically connected to the rest of system 200 to radiate the corresponding beam over the corresponding sector area. First radiating array 215 and second radiating array 220 each have their own polarization. Generally, this polarization is inherent to the particular radiating array and cannot be changed. In an embodiment, the desired polarization may be achieved be activating the radiating array corresponding to that polarization. For example, this polarization may include horizontal polarization, vertical polarization, left hand circular polarization, or right hand circular polarization.

Figure 3:
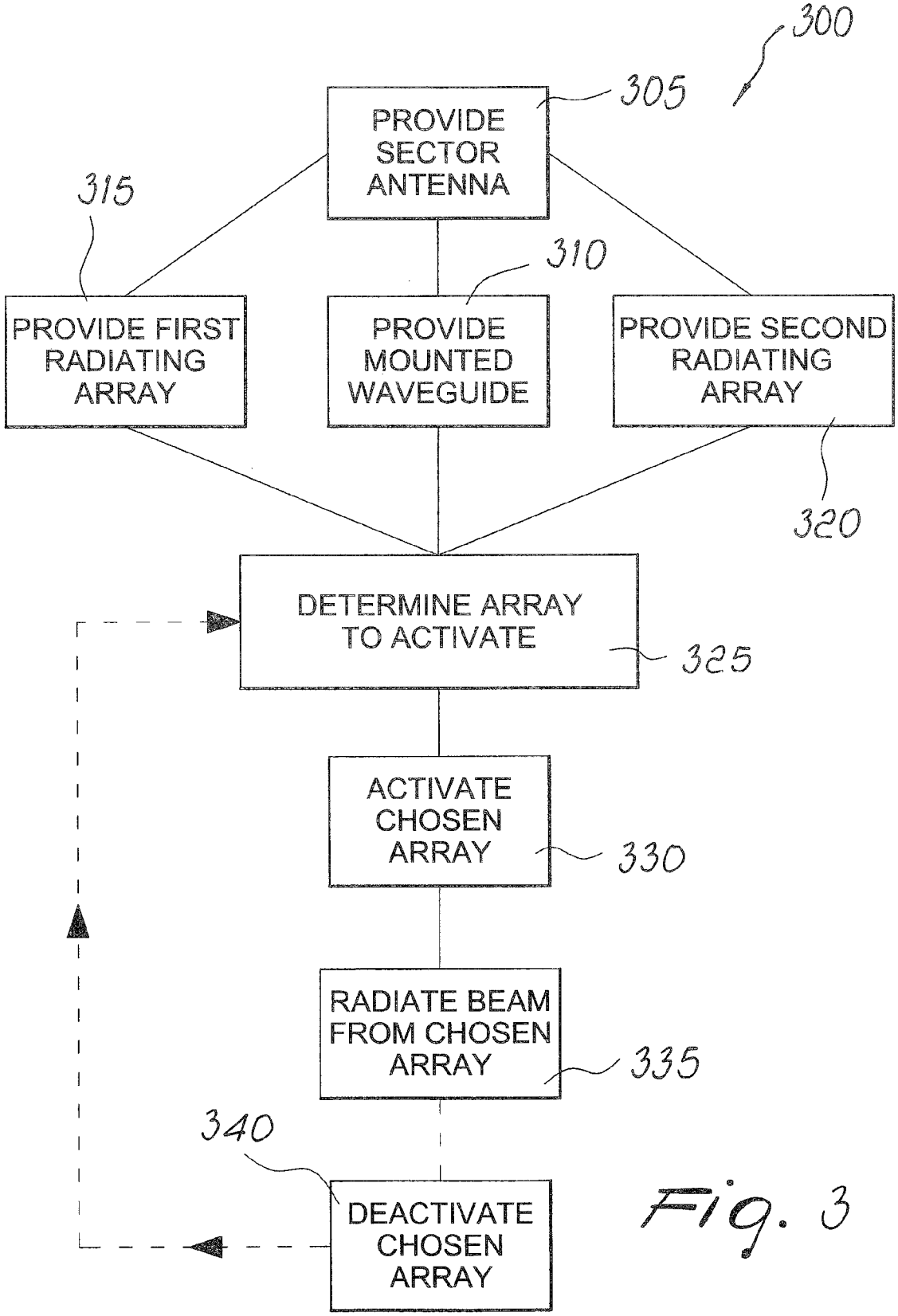
FIG. 3 is a flowchart depicting a method for configuring a sector antenna with multiple radiating arrays to radiate in one of a plurality of sector areas in accordance with an embodiment of the invention.

In brief overview, FIG. 3 is a flowchart that depicts a method 300 for configuring a sector antenna with multiple radiating arrays to radiate in one of a plurality of sector areas in accordance with an embodiment of the invention. The method includes a step of first providing a sector antenna mounted to a housing (STEP 305). The sector antenna may be any antenna capable of radiating over a particular geographic sector area. The sector antenna may include at least one point to multipoint base station sector antenna. Moreover, the sector antenna may include at least one patch antenna. In various embodiments, method 300 may provide more than one sector antenna. Following the provision of the sector antenna, an embodiment of the invention includes providing a waveguide mounted to the housing (STEP 310). Generally, a waveguide is a structure that confines and guides a propagating electromagnetic wave.

The method 300 next includes the step of providing a first radiating array (STEP 315). Generally the first radiating array is designed to radiate at a particular aperture angle, over a particular sector area. For example, in an embodiment, a radiating array could be designed to generate a 90 degree aperture, or beam, angle corresponding to a particular sector area. The method 300 also includes the step of providing a second radiating array (STEP 320). Generally, the second radiating array is designed to radiate over a particular sector area that is different from the sector area associated with the first radiating array. In an embodiment, the sector area associated with the second radiating array may at least partially overlap with the sector area associated with the first radiating array. In various embodiments, the sector antenna may include any number of radiating arrays (i.e., at least a third radiating array) similar to each of the first radiating array and the second radiating array.

After the provision of the first radiating array (STEP 315) and the second radiating array (STEP 320), method 300 continues by determining which of the first radiating array and the second radiating array to activate (STEP 325). Typically, only a single radiating array may be active at any one time, although in an alternative embodiment, more than one radiating array may be active simultaneously. In an embodiment, method 300 determines a single radiating array to activate from a choice of any number of radiating arrays, which may be greater than two. Generally the determination of which of the first radiating array and the second radiating array to activate (STEP 325) is made during the assembly of the sector antenna. However, in an embodiment, the determination of which of the first radiating array and the second radiating array to activate (STEP 325) is made after assembly of the sector antenna.

After determining which of the first radiating array and the second radiating array to activate, different embodiments of the invention activate the chosen radiating array (STEP 330). In various embodiments, the chosen radiating array may be activated during manufacture (i.e. assembly) of the sector antenna. In other embodiments, the chosen radiating array may be activated after assembly by, for example, a service technician. Typically, the chosen radiating array is activated (STEP 330) by electrically or mechanically connecting or coupling the waveguide to the chosen radiating array to allow beam propagation. Generally, the radiating array chosen to be activated is selected from the group consisting of the first radiating array and the second radiating array. In an embodiment with more than two radiating arrays, the radiating array chosen to be activated is selected from the group consisting of all of the more than two radiating arrays. Generally, only one radiating array may be active at any given time, although various embodiments may include a plurality of active radiating arrays. Typically, an enabler facilitates the activation of a radiating array by functionally connecting a radiating array to the waveguide. Typically, the radiating array that is not activated, (i.e., the deactivated array) is mechanically and electrically disconnected from the waveguide, although it is still physically attached to the sector antenna or the housing. Thus, a mechanical device may need to be physically moved to perform activation of a radiating array. The enabler may include any such connecting or mechanical device, such as for example a transition, or more specifically a microstrip waveguide transition.

Once the chosen radiating array has been activated (STEP 330) method 300 next radiates a beam from the chosen radiating array (STEP 335) in conjunction with the waveguide. Generally, the beam is any electromagnetic wave capable of propagation through a waveguide. Typically, the beam that radiates from the sector antenna originates with the chosen activated radiating array. The beam radiates primarily over the sector area corresponding to the chosen activated radiating array. For example, the beam radiating from the first radiating array, defined as the first beam, radiates primarily over a first sector area, and the beam radiating from the second radiating array, defined as the second beam, radiates primarily over a second sector area. Generally, the respective beams may radiate over any degree angle between 0 and 360 degrees, such as, for example, 45, 90, 120, or 180 degrees to radiate over a plurality of sector areas.

In an embodiment, after a chosen radiating array is activated (STEP 330), method 300 may also include the step of deactivating the chosen radiating array (STEP 340). In various embodiments, the chosen radiating array may be deactivated (STEP 340) by disengaging the chosen radiating array from the waveguide. This deactivation (STEP 340) typically causes the beam from the chosen radiating array to cease radiating over its associated sector area. Generally, at this point there is no active radiating array, and thus no corresponding beam radiating over the corresponding sector area. In such a case, method 300 may then loop to again determine which radiating array to activate (STEP 325). In various embodiments, the radiating array that is determined to be activated (STEP 325) may or may not be a radiating array that has been previously activated.

From the foregoing, it will be appreciated that the systems and methods provided by the invention afford a simple and effective way to configure a single sector antenna to operate in one of many possible modes based on the activation of one of a plurality of radiating arrays without incurring operating losses or requiring complete sector antenna replacement. The plurality of radiating arrays according to embodiments of the invention are each able to radiate a beam over a different sector area and/or at a different polarization. This increases efficiency, lowers maintenance costs, and facilitates high volume manufacturing of a single, robust product.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

The invention claimed is:

1. A sector antenna apparatus configurable to radiate in at least one of a plurality of sector areas, comprising:

at least one sector antenna mounted to a housing;

a waveguide mounted to the housing;

the at least one sector antenna comprising a first radiating array capable of activation by engagement with the waveguide to radiate a first beam covering a first sector area;

the at least one sector antenna comprising a second radiating array capable of activation by engagement with the waveguide to radiate a second beam covering a second sector area; and an enabler to activate one of the first radiating array and the second radiating array by engaging the waveguide with one of the first radiating array and the second radiating array so that the sector antenna radiates one of the first beam and the second beam.

2. The apparatus of claim 1 wherein the sector antenna comprises a point to multipoint base station sector antenna.

3. The apparatus of claim 1 wherein the sector antenna comprises a patch antenna.

4. The apparatus of claim 1 wherein the first radiating array has a polarization different from that of the second radiating array.

5. The apparatus of claim 1 wherein the second radiating array comprises radiating a third beam covering a third sector area, wherein the second sector area and the third sector area in sum cover at least a portion of the first sector area.

6. The apparatus of claim 5 wherein the first beam comprises a 90 degree sector angle, wherein the second beam comprises a 45 degree sector angle, and wherein the third beam comprises a 45 degree sector angle.

7. The apparatus of claim 1 wherein the first beam comprises a 90 degree sector angle and wherein the second beam comprises a 45 degree sector angle.

8. The apparatus of claim 1 wherein the enabler deactivates the active one of the first radiating array and the second radiating array by disengaging from the waveguide one of the first radiating array and the second radiating array, and wherein the enabler subsequently activates one of the first radiating array and the second radiating array by engaging with the waveguide one of the first radiating array and the second radiating array.

9. The apparatus of claim 1 wherein a human services the enabler to activate one of the first radiating array and the second radiating array by engaging with the waveguide one of the first radiating array and the second radiating array so that the sector antenna radiates one of the first beam and the second beam.

10. The apparatus of claim 1 wherein the enabler comprises at least one mechanical connector to couple the waveguide to one of the first radiating array and the second radiating array.

11. The apparatus of claim 1 wherein the enabler activates one of the first radiating array and the second radiating array during assembly of the sector antenna apparatus.

12. The apparatus of claim 1 wherein the enabler activates one of the first radiating array and the second radiating array after assembly of the sector antenna apparatus.

13. A method for configuring a sector antenna to radiate in at least one of a plurality of sector areas, comprising:

providing a sector antenna mounted to a housing;

mounting a waveguide to a housing;

providing included in the sector antenna a first radiating array capable of activation by engagement with the waveguide to radiate a first beam covering a first sector area;

providing included in the sector antenna a second radiating array capable of activation by engagement with the waveguide to radiate a second beam covering a second sector area;

determining which of the first radiating array and the second radiating array to activate;

activating one of the first radiating array and the second radiating array by engaging the waveguide with one of the first radiating array and the second radiating array; and radiating from the sector antenna one of the first beam and the second beam.

14. The method of claim 13 wherein the sector antenna comprises a point to multipoint base station sector antenna.

15. The method of claim 13 wherein the sector antenna comprises a patch antenna.

16. The method of claim 13 wherein the first radiating array has a polarization different from that of the second radiating array.

17. The method of claim 13 wherein the sector antenna is capable of radiating a third beam covering a third sector area, wherein the second sector area and the third sector area in sum cover at least a portion of the first sector area.

18. The method of claim 13 wherein the first beam covers a 90 degree sector angle and wherein the second beam covers a 45 degree sector angle.

19. The method of claim 13 further comprising;

deactivating the activated one of the first radiating array and the second radiating array by disengaging from the waveguide the activated one of the first radiating array and the second radiating array;

activating one of the first radiating array and the second radiating array by engaging with the waveguide one of the first radiating array and the second radiating array; and radiating from the activated one of the first radiating array and the second radiating array one of the first beam and the second beam.

20. The method of claim 13, wherein the step of activating one of the first radiating array and the second radiating array by engaging the waveguide with one of the first radiating array and the second radiating array comprises:

servicing, by a human, the sector antenna to activate one of the first radiating array and the second radiating array by engaging with the waveguide one of the first radiating array and the second radiating array so that the sector antenna radiates one of the first beam and the second beam.

21. The method of claim 13, wherein the step of activating one of the first radiating array and the second radiating array by engaging the waveguide with one of the first radiating array and the second radiating array comprises:

mechanically connecting the waveguide to one of the first radiating array and the second radiating array.

22. The method of claim 13, wherein the step of activating one of the first radiating array and the second radiating array by engaging the waveguide with one of the first radiating array and the second radiating array comprises:

activating one of the first radiating array and the second radiating array during the manufacture of the sector antenna.

23. The method of claim 13, wherein the step of activating one of the first radiating array and the second radiating array by engaging the waveguide with one of the first radiating array and the second radiating array comprises: activating one of the first radiating array and the second radiating array after the manufacture of the sector antenna.

* * * * *